US006499531B1

(12) United States Patent
Knudsen

(10) Patent No.: US 6,499,531 B1
(45) Date of Patent: Dec. 31, 2002

(54) MACHINE FOR PRODUCING FLASKLESS MOULDS

(75) Inventor: Søren Erik Knudsen, Værløse (DK)

(73) Assignee: Disa Industries A/S, Herlev (DK)

( * ) Notice: Subject to any disclaimer, the term of this patent is extended or adjusted under 35 U.S.C. 154(b) by 0 days.

(21) Appl. No.: 09/889,879

(22) PCT Filed: Feb. 23, 1999

(86) PCT No.: PCT/DK99/00077

§ 371 (c)(1),
(2), (4) Date: Jul. 24, 2001

(87) PCT Pub. No.: WO00/50187

PCT Pub. Date: Aug. 31, 2000

(51) Int. Cl.[7] ..... B22C 11/00
(52) U.S. Cl. ..... 164/211; 164/169
(58) Field of Search ..... 164/169, 180, 164/181, 182, 183, 184, 200, 201, 202, 207, 211, 322, 37, 129, 130

(56) References Cited

U.S. PATENT DOCUMENTS 3,589,431 A * 6/1971 Fellows ..... 164/172
3,630,268 A * 12/1971 Hatch ..... 164/181
4,437,507 A * 3/1984 Seeley ..... 164/173
4,463,794 A * 8/1984 Shioda ..... 164/182
4,565,232 A * 1/1986 Abraham ..... 164/181
5,246,058 A * 9/1993 Murata ..... 164/182

FOREIGN PATENT DOCUMENTS

DE DE 33 12 539 C1 * 3/1984 ..... B22C/15/02
EP 0 468 355 A2 * 1/1992 ..... B22C/11/10

* cited by examiner

*Primary Examiner*—M. Alexandra Elve
*Assistant Examiner*—Kevin P. Kerns
(74) *Attorney, Agent, or Firm*—Larson & Taylor PLC

(57) ABSTRACT

A molding machine for producing flaskless molds is provided with at least a cope flask and a drag flask and a pattern plate therebetween. The pair of flasks is alternatively positioned in a horizontal position in which the produced molds are removed and the pattern plate is inserted and removed, and in a vertical mold-forming position in which the sand is charged and compacted. The cope flask, the drag flask, the first squeeze plate, the second squeeze plate are rotatable in unison.

14 Claims, 11 Drawing Sheets

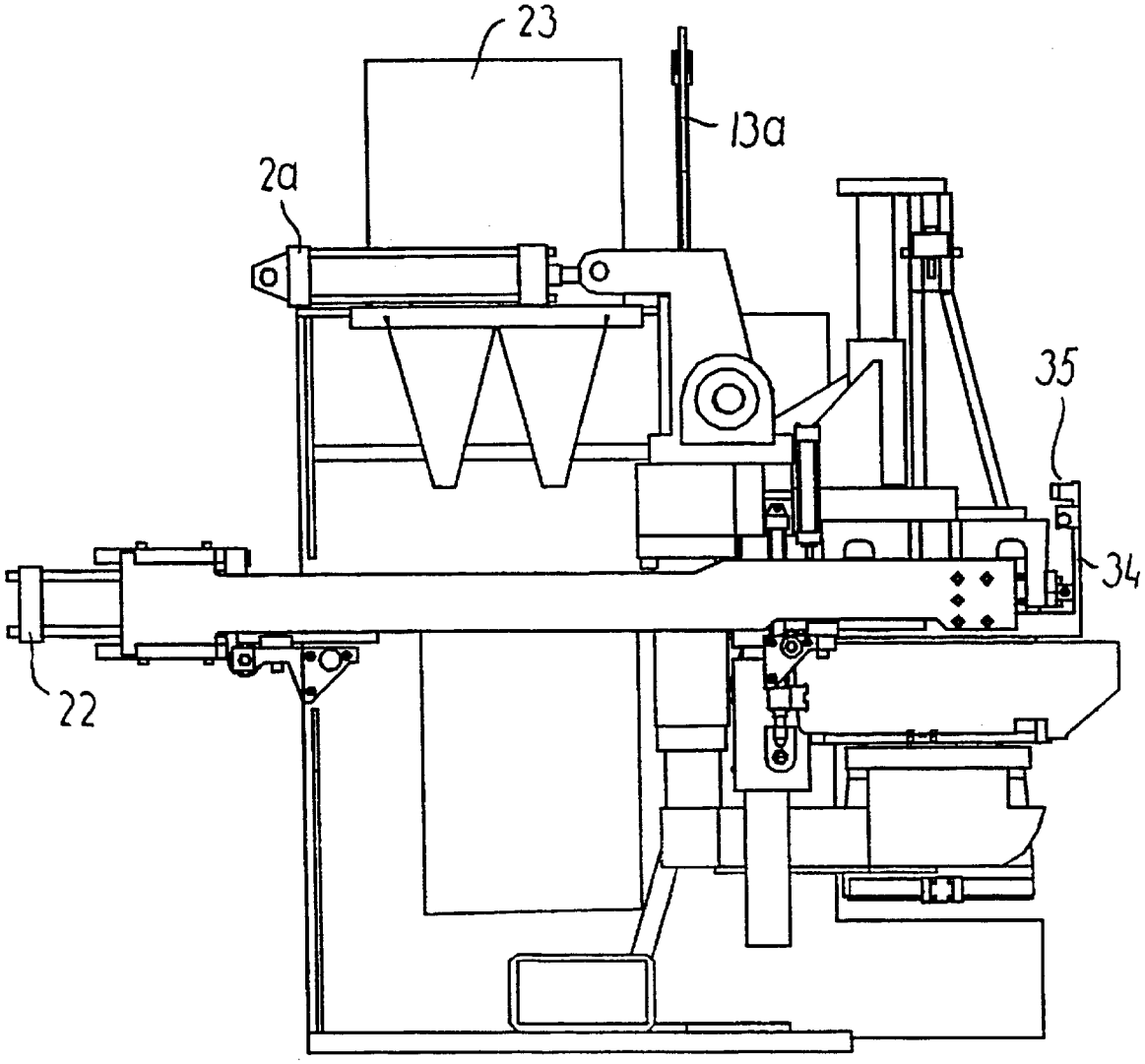
FIG. 4.1

MACHINE FOR PRODUCING FLASKLESS MOULDS

TECHNICAL FIELD

The present invention relates to a machine for producing flaskless moulds.

BACKGROUND ART

Document EP-0 468 355 discloses a conventional moulding forming machine of the above-mentioned type. This moulding machine is of a type in which a cope flask, a pattern plate and a drag flask are capable of rotating over an angle of 90° between a horizontal position and a vertical position. The horizontal position is associated with inserting the pattern plate between the cope and drag flask before the sand charging and compacting step and is associated with the removing of the pattern plate and the discharging of the cope and drag after the charging and compacting step. The sand charging and compacting step is performed with the cope flask, drag flask and pattern plate in the vertical position. The prior art moulding machine uses a first squeeze plate for compacting the sand in the cope flask (the upper flask by definition) and a second squeeze plate for compacting the sand in the drag flask (the lower flask by definition). The second squeeze plate is inserted into the drag flask when the latter is in the vertical position. Because of the rotating movement of the drag flask with respect to the fixed second squeeze plate, it is difficult to align the drag flask with the second squeeze plate in a precise and reproducible manner. The exact alignment in the prior art machine has to be carried out by the compression frame, which has already another important function, namely the transmission of the force for compacting the sand from one squeeze plate to the other. Therefore, the above described second squeeze plate cannot always be smoothly introduced into the drag flask due to deviations in the alignment of the two components.

It is the object of the present invention to provide a moulding machine for producing flaskless moulds of the kind referred to above, with which it is possible to overcome the disadvantages mentioned above and which allows easier alignment of the second squeeze plate with the drag flask, thus resulting in a simpler construction of the components of the machine and in higher quality drags and copes. This object is achieved with a machine for producing flaskless moulds in which the cope flask with a first squeeze plate and the drag flask with an associated second squeeze plate are supported by a swing frame and rotatable in unison between the horizontal position and the vertical position. With this arrangement, the alignment function of the compression frame is transferred to the swing frame which takes care of all alignment, whereas the compression frame is only constructed to transmit the relatively large forces related to the compacting of the sand. Thus, the second squeeze plate is always kept in alignment, avoiding problems associated with reproducibility of position. The lower and upper squeeze plates as well as the drag and cope flask are rotated over approximately 90° to take their vertical position in which the cope flask and drag flask are filled with sand. After the sand-filling, the compacting of the sand also takes place in, the vertical position.

According to a further embodiment, the swing frame which carries the squeeze plates and the flasks is received in an opening in the compression frame.

According to another embodiment of the invention, the drag flask is arranged to be movable up and down with respect to the fixed cope flask when the cope flask and drag flask are in their horizontal position.

In an embodiment of the present invention, the second squeeze plate is inserted in the drag flask when the cope flask and drag flask are in their horizontal position.

According to a further embodiment, the second squeeze plate serves as a table to receive and lower the superposed cope and drag when the latter are discharged from the cope flask and drag flask, thus doing away with the need for an additional transport table.

According to a further embodiment, the sand-charging openings of the respective cope flask and drag flask will, when the latter are moved into their vertical position, engage the sand-blowing nozzles of the blowhead.

BRIEF DESCRIPTION OF THE DRAWINGS

In the following detailed part of the present description, the invention will be explained in more detail with reference to the exemplary embodiments of the machine for producing flaskless moulds according to the invention shown in the drawings, in which.

DESCRIPTION OF THE PREFERRED EMBODIMENTS

Figure 1:
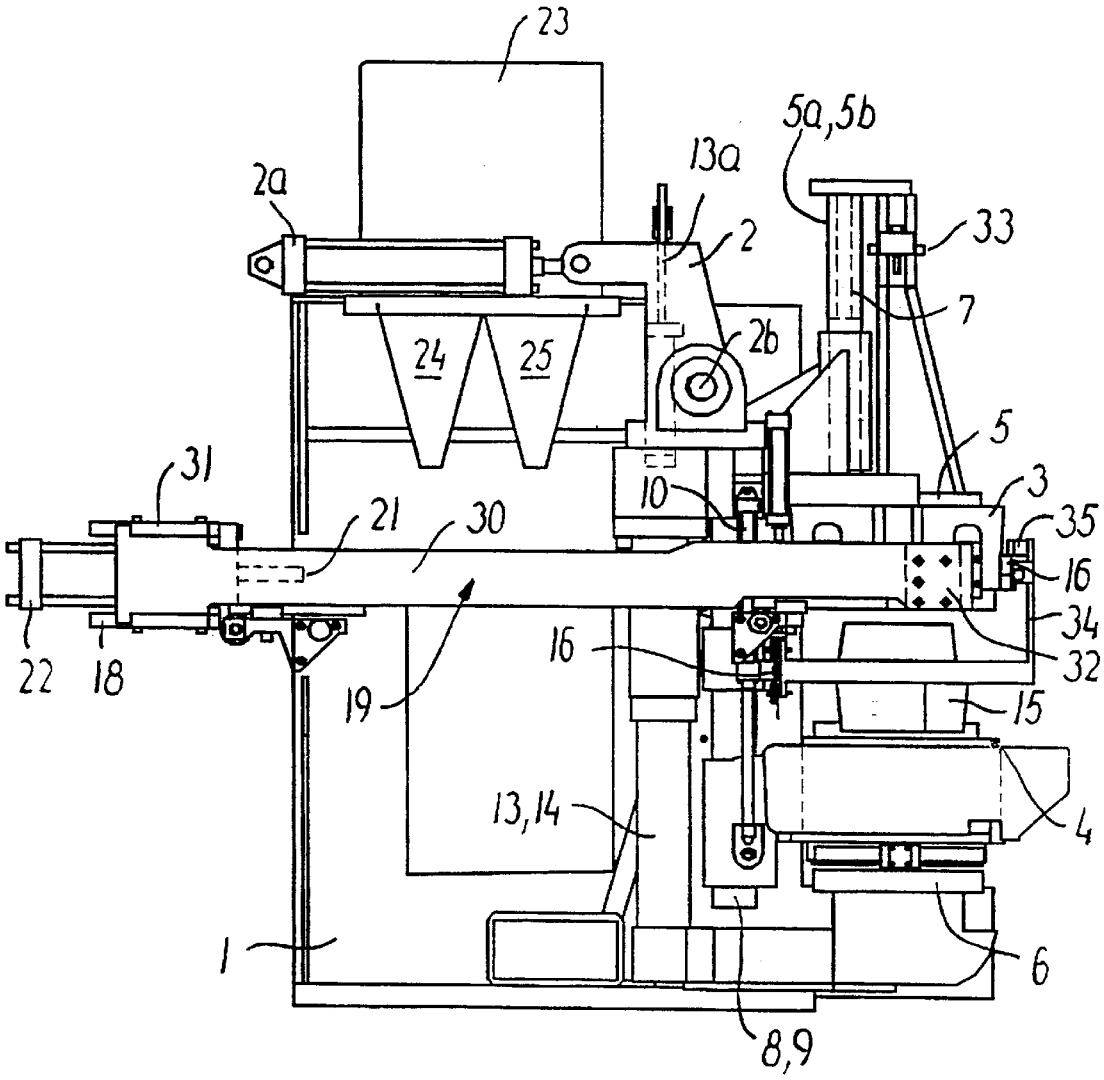
FIG. 1 shows a view of the moulding machine from the side in a state just before a mould-forming operation.
Figure 3:
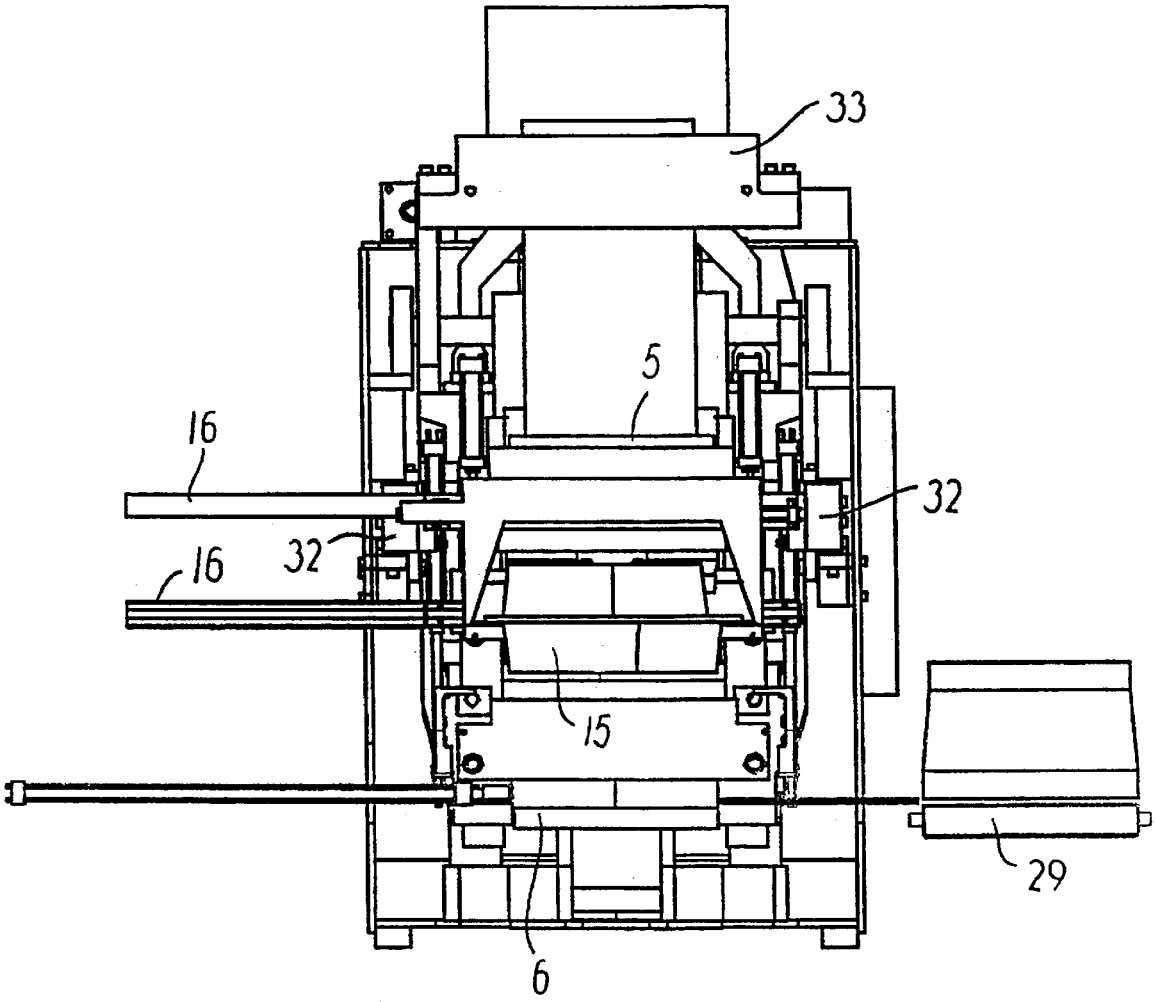
FIG. 3 shows the state in which the pattern plate has been inserted into the machine.
Figure 4:
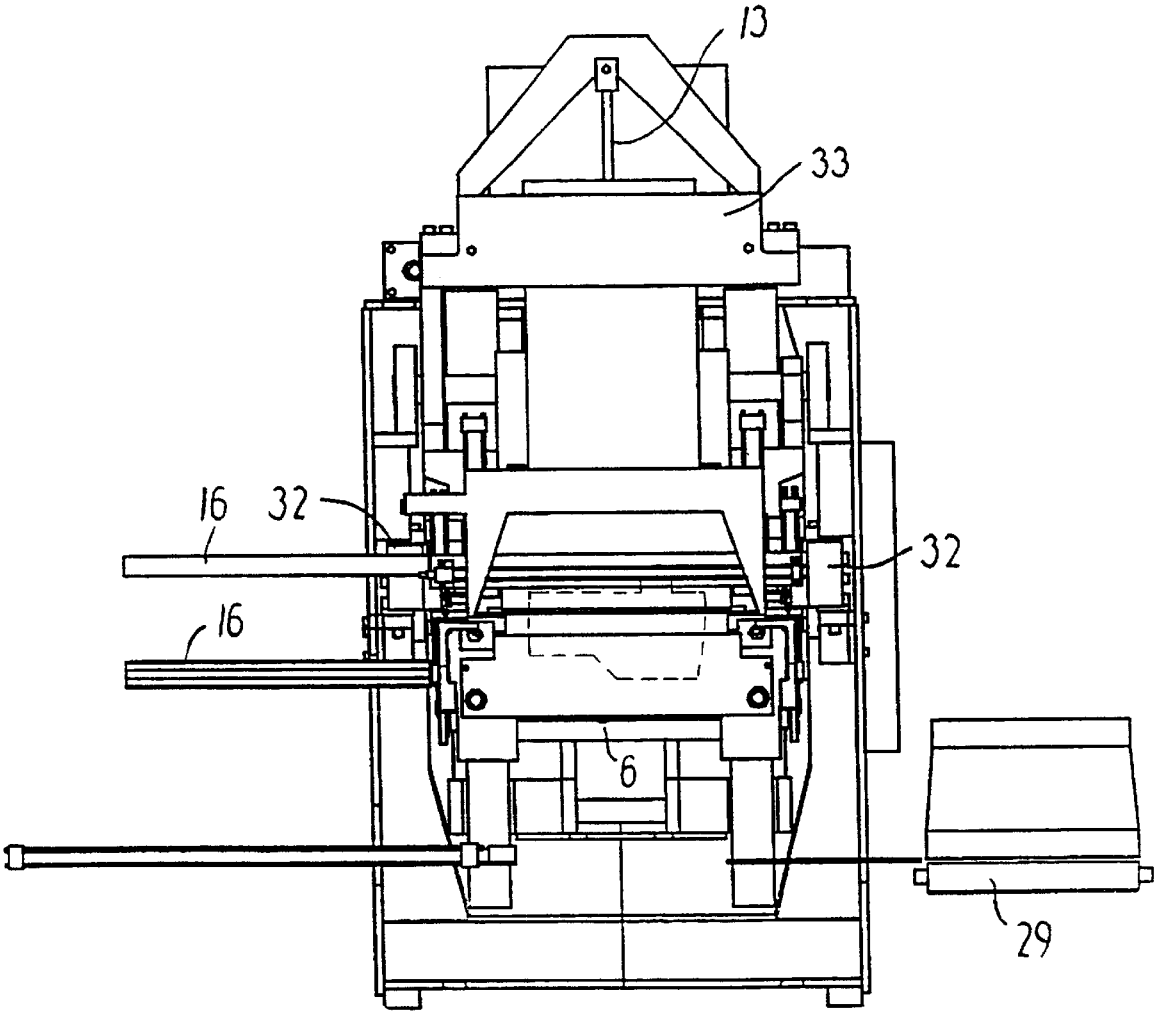
FIG. 4 shows the machine in a state in which the mould flasks are brought together with the pattern plate in between them, FIG. 4.1 shows the machine in the same state as in FIG. 4 from the side.
Figure 5:
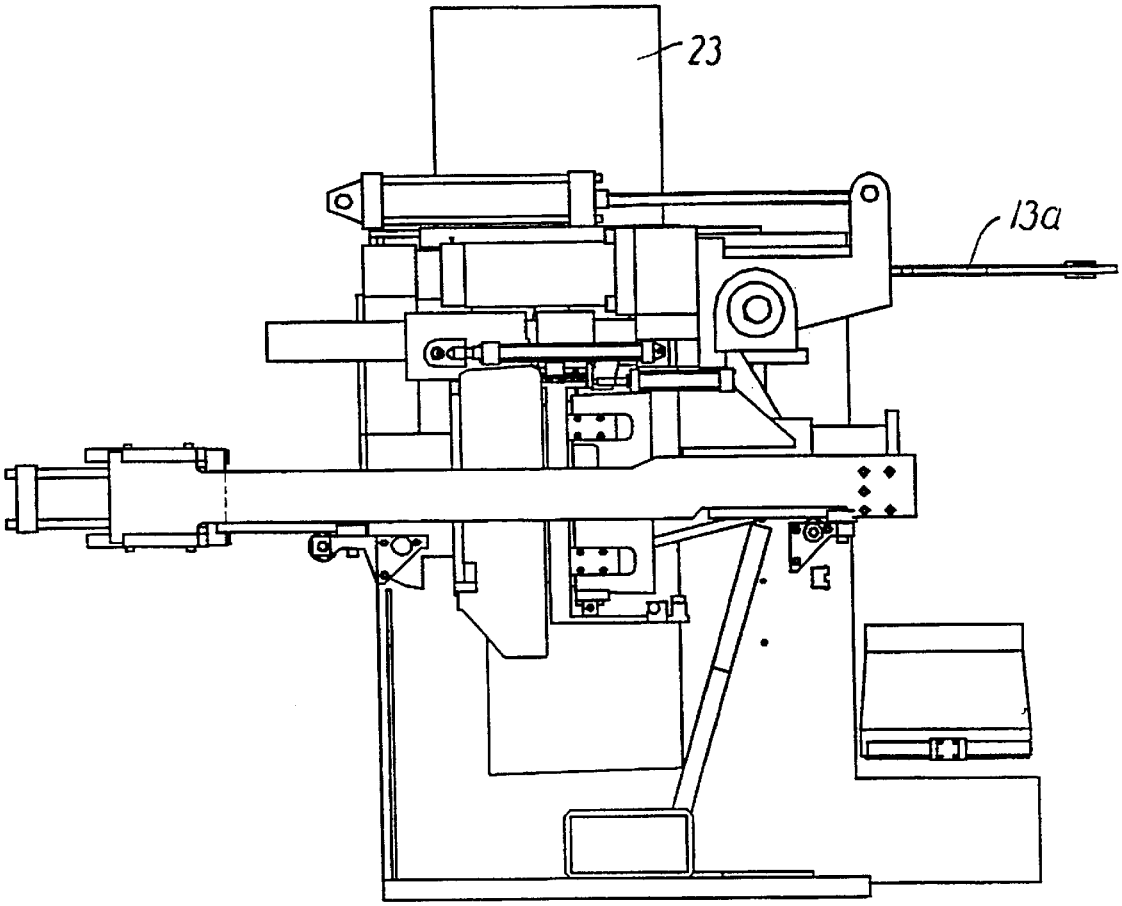
FIG. 5 shows the machine in a side view, with the flasks and squeeze plate arrangement rotated into the vertical position and the flasks being filled with sand.
Figure 6:
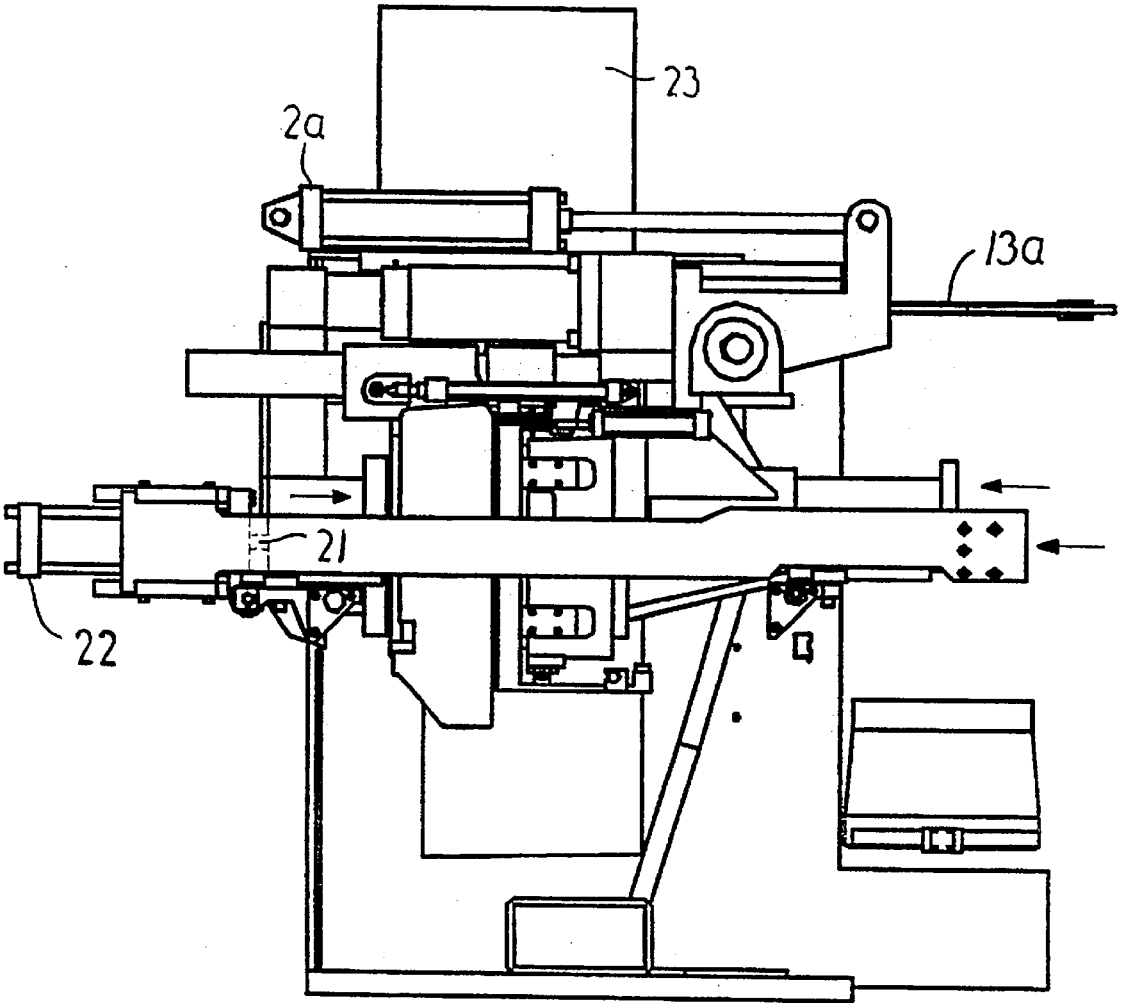
FIG. 6 shows the next state in which the sand is being compacted.

FIGS. 1–10 elucidate the steps which are carried out by the machine according to the invention in order to produce a flaskless mould. FIGS. 1, 5 and 6 are side views of the machine, whereas for practical reasons FIGS. 2–4 and 7–9 are front views of the machine according to the invention. The moulding machine shown in FIG. 1 is provided with a base frame 1 which carries the other components of the machine. A swing frame 2 is rotatably mounted to the base frame 1 through a shaft 2*b*. The swing frame can be rotated by an actuator 2*a*. The actuator 2*a* is preferably a hydraulic cylinder fastened to the base frame 1 at one of its lateral ends and with its piston rod fastened to the swing frame 2 at a suitable distance from the shaft 2*b*. The swing frame 2 supports the cope flask 3 and drag flask 4 as well as the first squeeze plate 5 and second squeeze plate 6. The cope flask 3 is fixed on the swing frame 2. The first squeeze plate 5 is suspended by two guide rods 5*a*, 5*b* from the swing frame 2 by a linear bearing which allows a relative movement of the first squeeze plate 5 with respect to the cope flask 3. The upper ends of the guide rods 5*a*, 5*b* are connected to one another by a bracket 33. A first linear actuator 7, preferably a hydraulic actuator, is secured at one of its ends to the swing frame 2 and at its other end to the bracket 33 so that the first squeeze plate may be moved up and down. The first squeeze plate 5 is movably fitted in the cope flask 3.

A drag flask 4 is disposed below the cope flask 3. The drag flask 4 is suspended from the swing frame 2 by a pair of guide rods 8, 9 to allow a linear movement with respect to the latter. The guide rods 8, 9 are connected at one of their lateral ends to the swing frame and their opposite lateral ends are inserted into linear bearings in the drag flask 4. Two second linear actuators 10 are fastened with one end to the drag flask 4 and at the opposite end to the swing frame 2. Thus, the drag flask 4 can be moved up and down by the second actuators in order to move the drag flask 4 towards and away from the cope flask 3.

The cope flask 3 and the drag flask 4 define on their right-side wall ("right" as in FIG. 1) sand-charging openings 11, 12. The sand-charging openings are placed such that they abut with sand-blowing nozzles 24, 25, when the cope flask 3 and the drag flask 4 are rotated to the vertical position.

The second squeeze plate 6 is movably fitted within the drag flask 4. The second squeeze plate 6 is suspended from the swing frame by a second pair of guide rods 13, 14 which are inserted in linear bearings in the swing frame 2. One third actuator 13*a*, preferably in the form of a hydraulic cylinder which may also provide for the linear bearing function, is fastened on one of its ends to the swing frame 2 and at its opposite end to the second squeeze plate 6 for allowing movement up and down of the squeeze plate 6.

Figure 2:
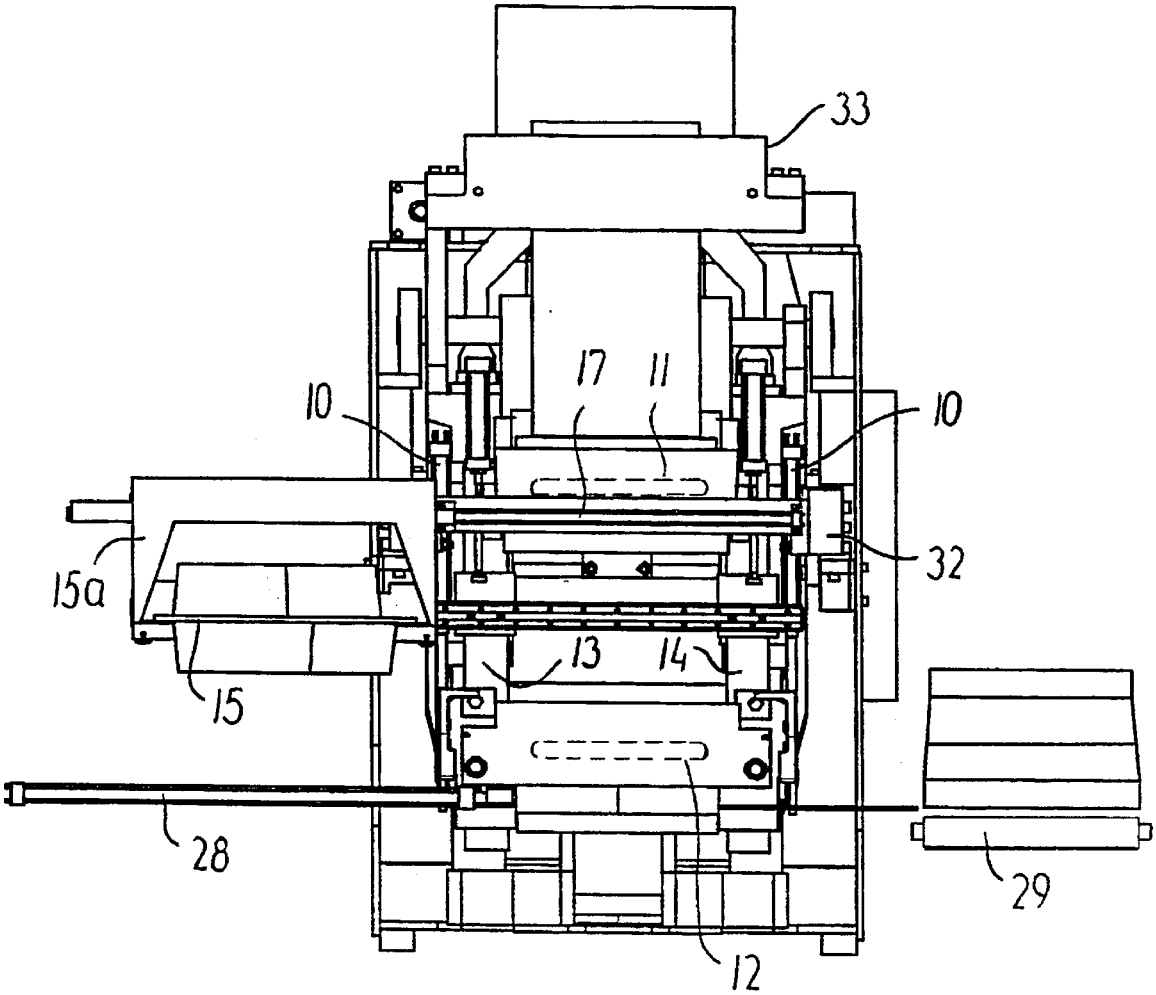
FIG. 2 shows the machine in the same state from the front.

A pattern plate 15 is suspended from the swing frame 2 in order to allow a horizontal translative movement of the pattern plate 15 in and out of the space between the flasks (FIG. 2). The pattern plate carrier 15*a* has suspending members 34 at two corners thereof, each of the suspending members having a roller 35 at the top portion thereof, and two rollers 35 are attached to the remaining two corners of the carrier plate 15*a*. Both the cope flask 3 and the rotatable swing frame 2 have on the front surface thereof, a rail 16 disposed horizontally to correspond to the rollers 35. A fourth actuator 17 secured at one of its ends to the cope flask and at its opposite end to the pattern plate carrier allows movement of the pattern plate in and out of the moulding machine.

A compression frame 18, carried by the base frame 1, extends horizontally. The compression frame 18 is suspended from the base frame so as to allow a horizontal translative movement in order to allow equalization of the force exercised on the first squeeze plate 5 to the second squeeze plate 6. The compression frame 18 comprises a tie 30 arranged horizontally, longitudinally and laterally disposed on each side of the rotatable frame. The ties 30 are guided so as to allow the above-mentioned horizontal translative movement. The ties 30 are connected to each other at one of their lateral end portions by a connection bar 31. Thus, the compression frame 18 defines an opening 19 between the two ties which is large enough to receive the rotatable frame 2 together with the drag flask 4 and the cope flask 3 in both the vertical and the horizontal position. A fifth linear actuator 22, preferably a hydraulic cylinder having a piston rod 21, is fastened to the connection bar 31. The second squeeze plate 6 is moved towards the pattern plate 15 by the force of the hydraulic cylinder 22 by the piston rod 21 engaging the second squeeze plate 6. The compression frame 18 transmits this force through the ties to its other lateral end which is open, i.e., the other lateral ends of the ties 30 are not connected to one another. These lateral ends of the ties 30 are provided with abutment plates 32 which extend towards one another. The abutment plates 32 engage with the bracket 33 for transmitting the compression force to the first squeeze plate 5.

A blowhead 23 with a sand-inlet part at its top and two sand-blowing nozzles 24, 25 at its lower side is attached to the base frame 1 in a position so that the sand-blowing nozzles 24,25 will engage the respective sand-charging openings 11, 12 of the drag flask 4 and cope flask 3 when the latter are in their vertical position.

The production process of moulding a flaskless mould comprising two mould halves with the machine according to the invention will now be described with reference to FIGS. 1–10. The sequence of operation starts in the state shown in FIGS. 1 and 2, with the flasks in a horizontal position and with the drag flask lowered to its lowermost position. Next, the pattern plate 15 is displaced laterally into the space between the cope flask 3 and the drag flask 4 (FIG. 3). The drag flask 4 and the second squeeze plate 6 are moved upwards towards the cope flask 3 by the second actuator 10 and the third actuators 13*a,* respectively, thereby clamping the pattern plate 15 between the cope flask 3 and the drag flask 4. In this state, the first squeeze plate 5, is inserted into the cope flask 3, the second squeeze plate 6 is inserted into the drag flask 4, and these components are all in alignment (FIG. 4).

In the next step, the swing frame is rotated over 90° from the horizontal position to the vertical position by the hydraulic cylinder 2*a*, as shown in FIG. 5. The sand-blowing nozzles 24, 25 of the blowhead 23 now abut with the sand-charging openings 11, 12 of the respective flask. In the following step, the mould-half forming spaces in the cope flask 3 and the drag flask 4 are filled with sand by supplying compressed air into the blowhead 23.

Thereafter, the charged sand is compacted by the first pressure plate 5 and second pressure plate 6 being forced further into the cope flask 3 and drag flask 4, respectively. Hereto the fifth actuator 22 which is fastened to the right-side compression frame 18 and the piston rod 21 is actuated so that the piston rod 21 forces the second squeeze plate 6 into the drag flask 4. The force thus exercised on the drag flask is transmitted through the compression frame to the first squeeze plate via the abutment plates 32 and the bracket 33. Since the compression frame 18 is horizontally suspended so that it can move longitudinally, the force exercised on the pressure plates is equalized (FIG. 6). As a result, a cope 26 and a drag 27 are moulded by compression in the cope flask 3 and the drag flask 4.

Figure 7:
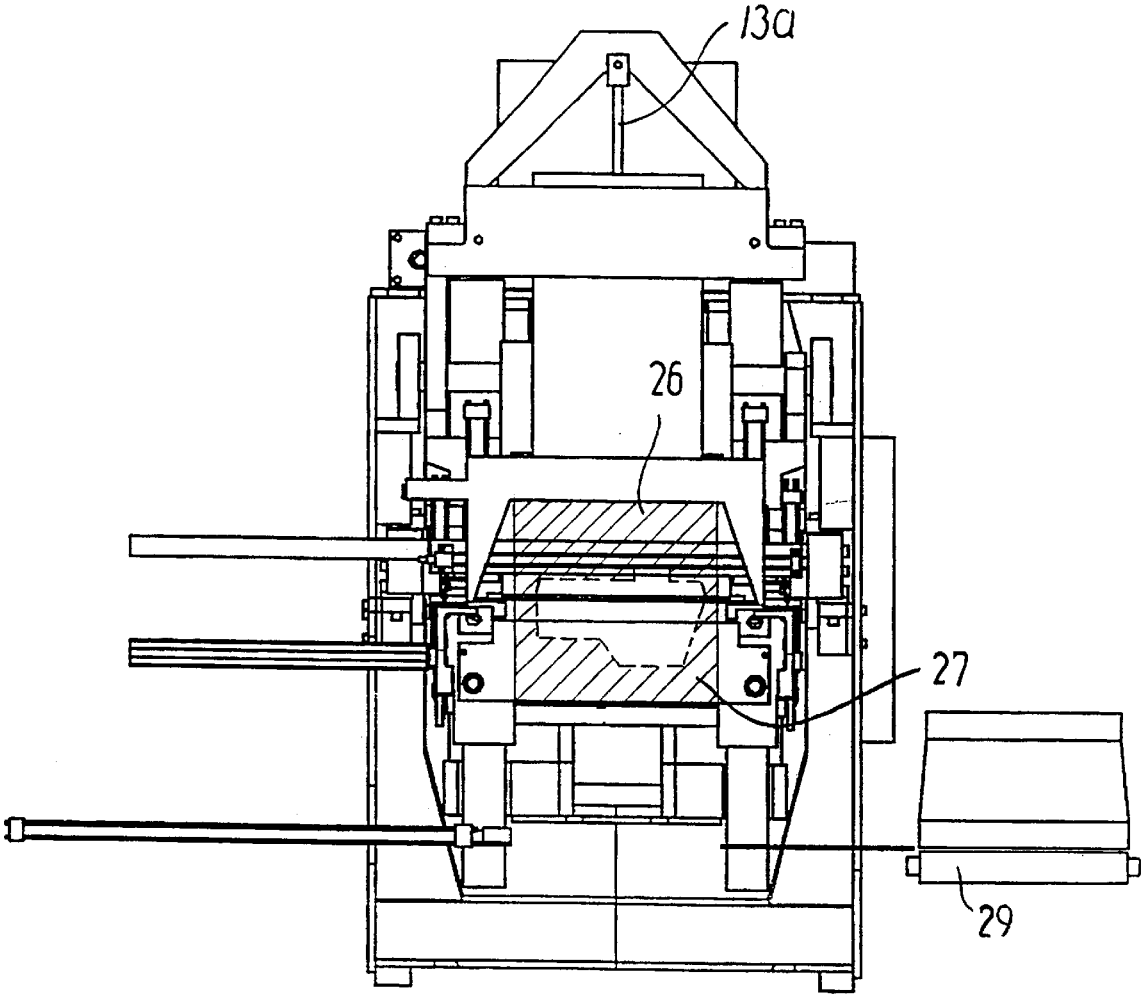
FIG. 7 shows the flasks containing compacted sand returned in the horizontal position.
Figure 8:
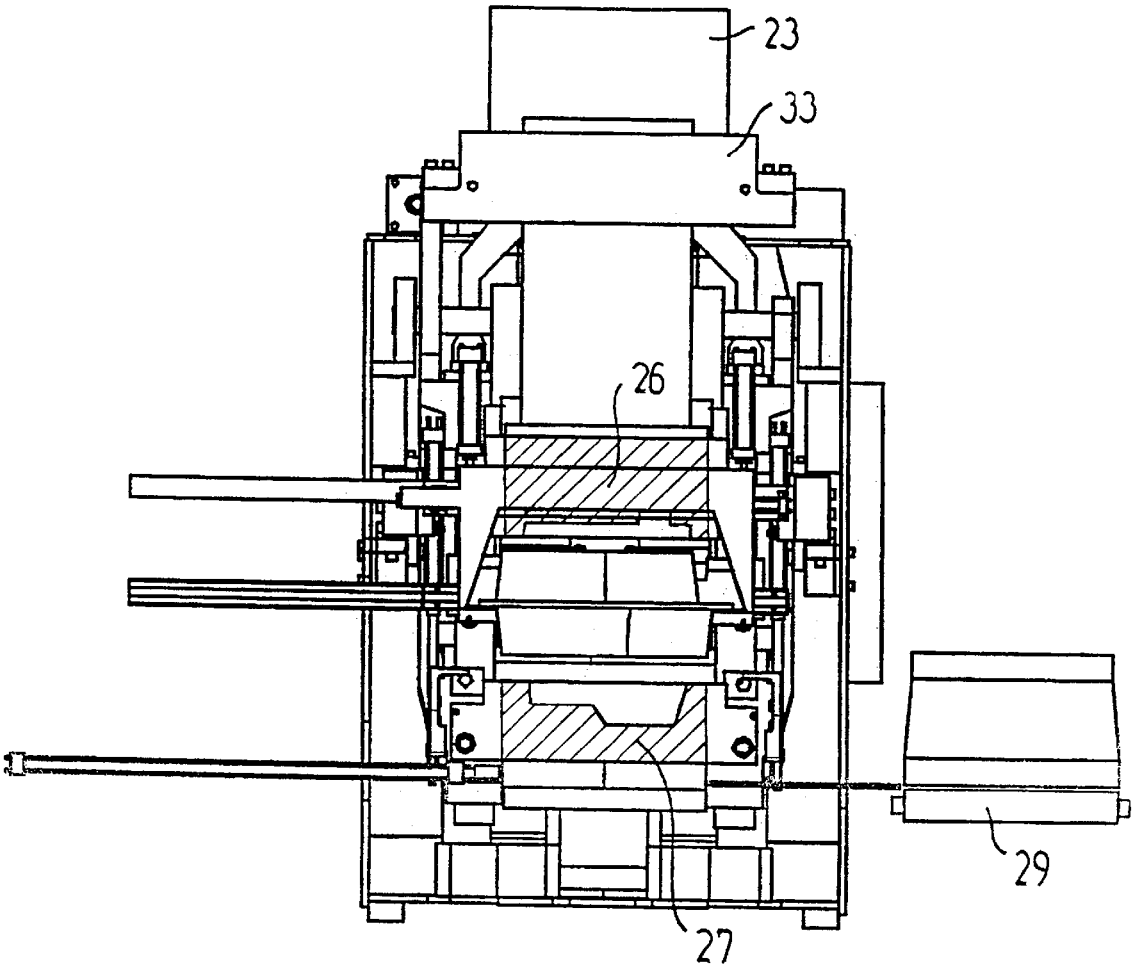
FIG. 8 shows a view from the side as in FIG. 2, but with the drag flask lowered in order to allow the pattern plate to be taken out of the moulding machine.

After a predetermined time interval, in which the squeezing is completed, as a next step, the swing frame 2 is rotated over 90° back from the vertical position to its starting position, in which the cope flask 3 and drag flask 4 take their horizontal position (FIG. 7).

Figure 9:
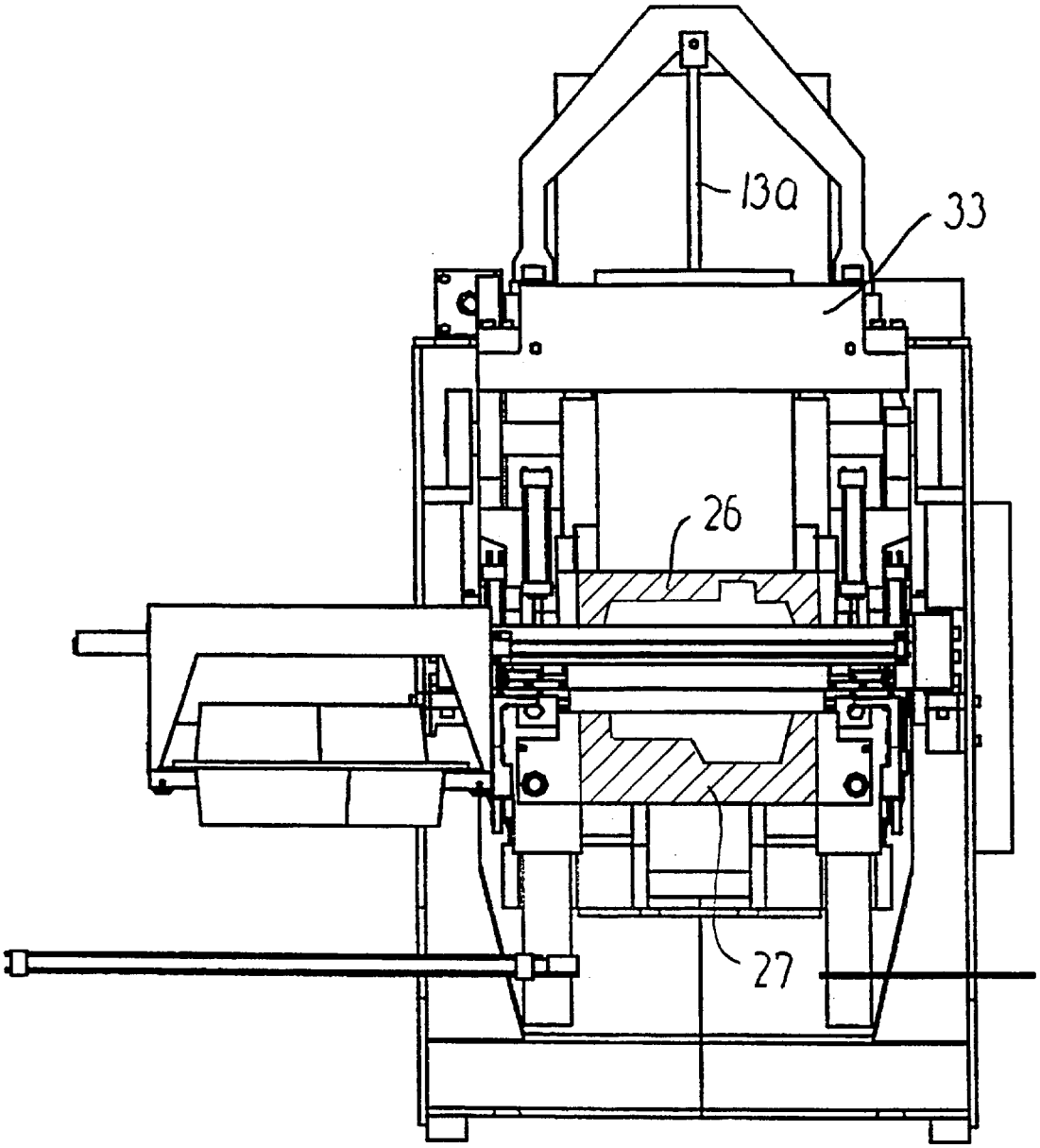
FIG. 9 shows the next state in which the flasks with the cope and drag are brought together again without the pattern plate between them in order to allow for the now superposed cope and drag to be ejected from the flasks.

In a further step, the drag flask 4 and the lower squeeze plate 6 are lowered in unison and the pattern plate 15 is lowered to take its position in between the cope flask 3 and the drag flask 4 (FIG. 8), causing the pattern plate 15 to separate from the cope flask 3 by being lowered while resting on the drag flask until the rollers 35 of the suspending member 34 engage the rails 16. Next, the pattern plate 15 is retracted from the space between the cope flask 3 and the drag flask 4 by the fourth actuator 17 to take its position as shown in FIG. 2. The drag flask 4 and the second squeeze plate 6 are raised in unison until the upper surface of the drag flask 4 is in contact with the lower surface of the cope flask 3, causing the mould surface of the cope to be brought into contact with the mould surface of the drag. Thus, the cope 26 and the drag 27 are superposed (FIG. 9).

Figure 10:
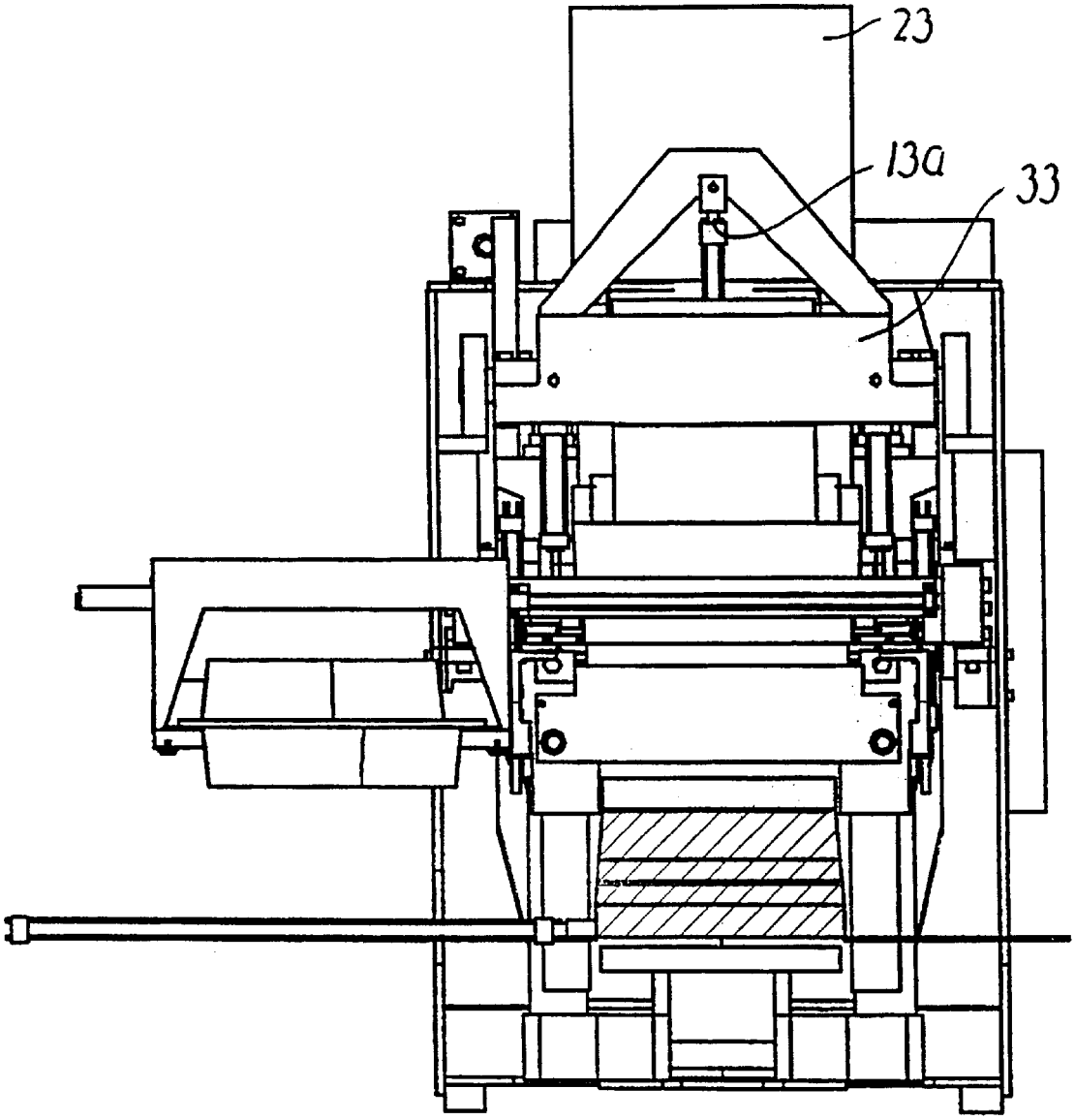
FIG. 10 shows the machine in a state in which the superposed cope and drag are placed on the lower squeeze plate which has been lowered so that the finished mould can be ejected on to a conveying means next to the moulding machine.

Thereafter, the first squeeze plate 5 is lowered by the first actuator 7 to separate the cope 26 and drag 27 from the cope flask 3 and drag flask 4. The second squeeze plate 6 is simultaneously lowered and serves as a table for the superposed cope 26 and drag 27 and transports the cope 26 and drag 27 downwards to a position in which the superposed cope 26 and drag 27 can be expelled from the moulding machine (FIG. 10). In the following step, a sixth actuator 28 pushes the superposed cope 26 and drag 27 from the lowered second squeeze plate 6 onto a conveyor means 29 adjacent to the moulding machine.

The machine has reached its starting position again and is ready for producing the next mould, as part of a cycle operation which is repeated for mass production of flaskless moulds.

Although the above described embodiment is illustrated with a fixed cope flask 3 and a movable drag flask 4, the cope flask 3 may instead be arranged movable and the drag flask 4 may be arranged fixed to the swing frame 2.

LIST OF REFERENCE NUMERALS

1 base frame
2 swing frame
2*a* actuator
2*b* shaft
3 cope flask
4 drag flask
5 first squeeze plate
6 second squeeze plate
7 first actuator
8 guide rod
9 guide rod
10 second actuator
11 sand-charging opening
12 sand-charging opening
13 guide rod
13*a* third actuator
14 guide rod
15 pattern plate
15*a* pattern plate carrier
16 rail
17 fourth actuator
18 compression frame
19 opening
21 piston rod
22 fifth linear actuator
23 blowhead
24 sand-blowing nozzle
25 sand-blowing nozzle
26 cope
27 drag
28 sixth actuator
29 conveyor means
30 tie
31 connection bar
32 abutment plates
33 bracket
34 suspending member
35 roller

What is claimed is:

1. A moulding machine for producing flaskless moulds comprising:

a drag flask and a cope flask rotatable between a horizontal position and a vertical position and movable relatively towards one another and away from one another in the horizontal position of said drag flask and cope flask, a first squeeze plate inserted in the cope flask, and a second squeeze plate associated with the drag flask, characterized in that the cope flask with the first squeeze plate and the drag flask with the associated second squeeze plate are supported by a swing frame and rotatable in unison between the horizontal position and the vertical position.

2. Moulding machine according to claim 1, characterized in that the drag flask is arranged to be movable up and down with respect to the cope flask when the cope flask and drag flask are in the horizontal position.

3. Moulding machine according to claim 1, characterized in that the second squeeze plate serves as a table to receive and lower a superposed cope and drag when the superposed cope and drag are discharged from the cope flask and drag flask.

4. Moulding machine according to claim 1, characterized by comprising an actuator for positioning and moving the second squeeze plate up and down when the cope flask and the drag flask are in the horizontal position.

5. Moulding machine according to claim 1, characterized in that the drag flask is suspended from the swing frame so as to allow a relative movement with respect to the swing frame for moving the drag flask to and from the cope flask.

6. Moulding machine according to claim 1, characterized in that the second squeeze plate is suspended from the swing frame so as to allow a relative movement with respect to the swing frame for moving the second squeeze plate towards and into the drag flask and vice versa.

7. Moulding machine according to claim 1, characterized by means associated with the swing frame for aligning the second squeeze plate with the drag flask.

8. Moulding machine according to claim 1, characterized by further comprising a horizontally extending compression frame for transmitting force applied on the one squeeze plate to the other squeeze plate.

9. Moulding machine according to claim 8, further comprising first drive means arranged at one lateral end of the compression frame for moving the second squeeze plate and second drive means arranged at the opposite end of the compression frame for moving the first squeeze plate.

10. Moulding machine according to claim 8, characterized by the drive means comprising a hydraulic cylinder fastened to one lateral end of the compression frame, with the piston rod of the hydraulic cylinder being arranged for abutment with the second squeeze plate.

11. Moulding machine according to claim 8, characterized in that the swing frame is received in an opening in the compression frame when the flasks are in the vertical position.

12. Moulding machine according to claim 1, characterized by further comprising means for inserting a pattern plate between the cope flask and the drag flask.

13. Moulding machine according to claim 1, characterized by the cope flask and drag flask having sand-charging openings in their respective side walls which form the top of the flasks when the flasks are in the vertical position.

14. Moulding machine according to claim 1, characterized by further comprising a fixed blowhead positioned so that the sand-blowing nozzles of the blowhead abut with the sand-charging opening of the respective flask, when the flasks are in the vertical position.

* * * * *